US009961959B2

(12) United States Patent
Gerber

(10) Patent No.: US 9,961,959 B2
(45) **Date of Patent: *May 8, 2018**

(54) SOLE STRUCTURE WITH TRACTION ELEMENTS

(71) Applicant: NIKE, Inc., Beaverton, OR (US)

(72) Inventor: Clifford Bruce Gerber, West Linn, OR (US)

(73) Assignee: NIKE, Inc., Beaverton, OR (US)

( * ) Notice: Subject to any disclaimer, the term of this patent is extended or adjusted under 35 U.S.C. 154(b) by 196 days.

This patent is subject to a terminal disclaimer.

(21) Appl. No.: 14/935,585

(22) Filed: Nov. 9, 2015

(65) Prior Publication Data

US 2016/0058120 A1 Mar. 3, 2016

Related U.S. Application Data

(62) Division of application No. 12/856,185, filed on Aug. 13, 2010, now Pat. No. 9,210,967.

(51) Int. Cl.

| | |
|---|---|
| ***A43B 5/02*** | (2006.01) |
| ***A43B 13/12*** | (2006.01) |
| ***A43B 13/14*** | (2006.01) |
| ***A43C 15/16*** | (2006.01) |
| ***A43B 13/18*** | (2006.01) |
| ***A43B 13/22*** | (2006.01) |
| ***A43B 13/26*** | (2006.01) |

(Continued)

(52) U.S. Cl.

CPC ..... *A43B 13/125* (2013.01); *A43B 5/00* (2013.01); *A43B 5/02* (2013.01); *A43B 13/026* (2013.01); *A43B 13/12* (2013.01); *A43B 13/14* (2013.01); *A43B 13/141* (2013.01); *A43B 13/145* (2013.01); *A43B 13/18* (2013.01); *A43B 13/22* (2013.01); *A43B 13/26* (2013.01); *A43C 15/16* (2013.01); *A43C 15/161* (2013.01); *A43C 15/168* (2013.01)

(58) Field of Classification Search

CPC ..... A43B 5/02; A43B 13/26; A43B 13/04; A43C 15/16; A43C 15/161; A43C 15/168

USPC .. 36/61, 67 R, 67 A, 59 A, 59 B, 59 C, 127, 36/128, 134

See application file for complete search history.

(56) References Cited

U.S. PATENT DOCUMENTS 4,715,133 A * 12/1987 Hartjes ..... A43B 5/001 36/127

4,897,936 A * 2/1990 Fuerst ..... A43B 13/223 36/114

(Continued)

*Primary Examiner* — Sharon M Prange

(74) *Attorney, Agent, or Firm* — Banner & Witcoff, Ltd.

(57) ABSTRACT

A sole structure for an article of footwear may include a frame member having a continuous opening with portions located in forefoot, midfoot and hindfoot regions. A plurality of primary traction elements may extend outward from the frame member. A compressible midsole may be bonded to upper surfaces of the frame member. A flexible support plate may be bonded to the midsole. The flexible support plate may span substantially all of the frame member opening and have a lower surface exposed in at least a forefoot region. The support plate may be isolated from the frame member by the compressible midsole. A plurality of secondary traction elements may be integral to and extend outward from the exposed lower surface of the support plate.

22 Claims, 8 Drawing Sheets

(51) Int. Cl.
*A43B 5/00* (2006.01)
*A43B 13/02* (2006.01)

(56) References Cited

U.S. PATENT DOCUMENTS

| | | | | | |
|---|---|---|---|---|---|
| 5,367,791 | A * | 11/1994 | Gross | A43B 13/26 | 36/25 R |
| 5,533,280 | A * | 7/1996 | Halliday | A43B 3/246 | 36/100 |
| 5,775,005 | A * | 7/1998 | McClelland | A43B 1/0072 | 36/134 |
| 7,010,872 | B2 * | 3/2006 | Pawlus | A43B 3/0047 | 36/100 |
| 7,140,129 | B2 * | 11/2006 | Newson | A43B 5/18 | 36/100 |
| 7,370,439 | B1 * | 5/2008 | Myers | A43B 13/26 | 36/134 |
| 7,578,076 | B2 * | 8/2009 | Pawlus | A43B 3/0047 | 36/100 |
| 7,954,257 | B2 * | 6/2011 | Banik | A43B 7/144 | 36/28 |
| 8,256,145 | B2 * | 9/2012 | Baucom | A43B 1/0018 | 36/61 |
| 2009/0056172 | A1 * | 3/2009 | Cho | A43B 7/081 | 36/3 B |
| 2011/0192056 | A1 * | 8/2011 | Geser | A43C 15/14 | 36/114 |

* cited by examiner

SOLE STRUCTURE WITH TRACTION ELEMENTS

CROSS-REFERENCE TO RELATED APPLICATION

This application is a division of U.S. application Ser. No. 12/856,185, titled "Sole Structure with Traction Elements" and filed Aug. 13, 2010, which application is incorporated by reference herein.

BACKGROUND

"Traction" is a general term that describes the ability of a shoe outsole to resist sliding motion over a surface contacted by that outsole. Traction is particularly important for footwear used in sports and other activities in which a shoe wearer wishes to move quickly and/or to rapidly change movement directions relative to a potentially slippery surface. For an athlete, secure, non-sliding contact between that athlete's footwear and a playing surface can be important for preventing injury and for improving the athlete's performance.

Soccer (also known as "football" outside of the United States), football (also known as "American football" outside of the United States) and other sports are often played on a grass-covered field, a dirt field or some other type of surface that is at least partially penetrable. It is known to include cleats or other traction-enhancing outsole extensions on footwear intended for use in such sports. During running or other actions, these extensions can penetrate the playing surface and help stabilize an athlete's foot from unwanted movement.

Unfortunately, a single cleat configuration for an athletic shoe may not be optimal over a range of conditions in which that shoe will be used. For example, playing surfaces for soccer and many other sports can have extremely variable conditions. If a playing surface is softer and/or more slippery, a larger number of cleats can be useful. When the ground is harder or less slippery, however, fewer cleats may be needed. An athlete may also need more traction during some specific movements (e.g., while running) and less traction during other actions (e.g., while standing).

Although useful to increase traction, outsole extensions can also be sources of discomfort. In particular, a protruding traction element can generate a point pressure on a shoe wearer's foot. An outsole extension that might be useful under some conditions (e.g., when running) may be a source of irritation under other conditions (e.g., when standing). Finding the correct balance between traction enhancement and comfort for cleated footwear thus remains an ongoing challenge.

SUMMARY

This Summary is provided to introduce a selection of concepts in a simplified form that are further described below in the Detailed Description. This Summary is not intended to identify key or essential features of the invention.

In at least some embodiments, a sole structure for an article of footwear may include a frame member. The frame member may include a lateral peripheral branch extending along a lateral side of the sole structure, a medial peripheral branch extending along a medial side of the sole structure, a toe bridge connecting the lateral and medial peripheral branches in a front portion of the sole structure, and a heel plate connecting the lateral and medial peripheral branches in a rear portion of the sole structure. The frame member may further define a continuous opening having portions located in forefoot, midfoot and hindfoot regions. A plurality of primary traction elements may extend outward from the frame member in a forefoot region, and additional outwardly extending traction elements may be located in other regions of the frame member.

The sole structure may further include a compressible midsole and a flexible support plate. The compressible midsole may be bonded to upper surfaces of the frame member and the flexible support plate may be bonded to the midsole. The flexible support plate may span substantially all of the frame member opening and have a lower surface exposed in at least a forefoot region of the that opening. The support plate may be isolated from the frame member by the compressible midsole. A plurality of secondary traction elements may be integral to and extend outward from the exposed lower surface of the support plate.

BRIEF DESCRIPTION OF THE DRAWINGS

Some embodiments are illustrated by way of example, and not by way of limitation, in the figures of the accompanying drawings and in which like reference numerals refer to similar elements.

DETAILED DESCRIPTION

Figure 1:
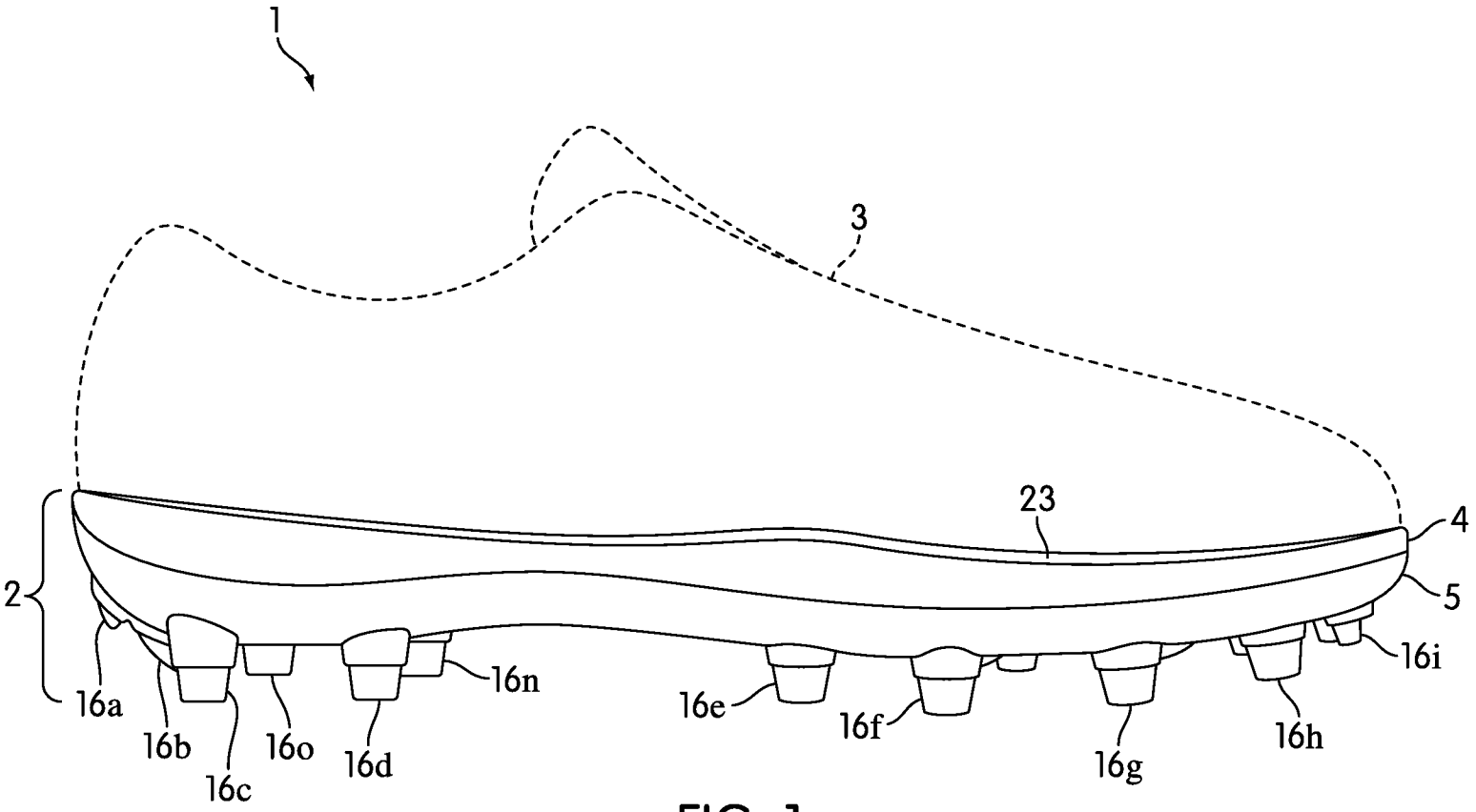
FIG. 1 is a lateral side view of an athletic shoe according to some embodiments.

FIG. 1 is a lateral side view of a shoe 1 having a sole structure 2 according to some embodiments. Shoe 1 can be a shoe intended for wear by a player of football, soccer or other sport(s). Embodiments can also include footwear for use in non-athletic activities. Although various specific features of sole structure 2 are described below, such description merely provides examples of features according to one or more embodiments.

Sole structure 2 includes a midsole 4 and a base member 5. These and other components of sole structure 2 are further described below. Shoe 1 also includes an upper 3. Shoes having sole structures according to various embodiments can include various types of uppers. Because the details of such uppers are not pertinent to understanding sole structures disclosed herein, upper 3 is shown generically in FIG. 1 using a broken line.

Figure 2:
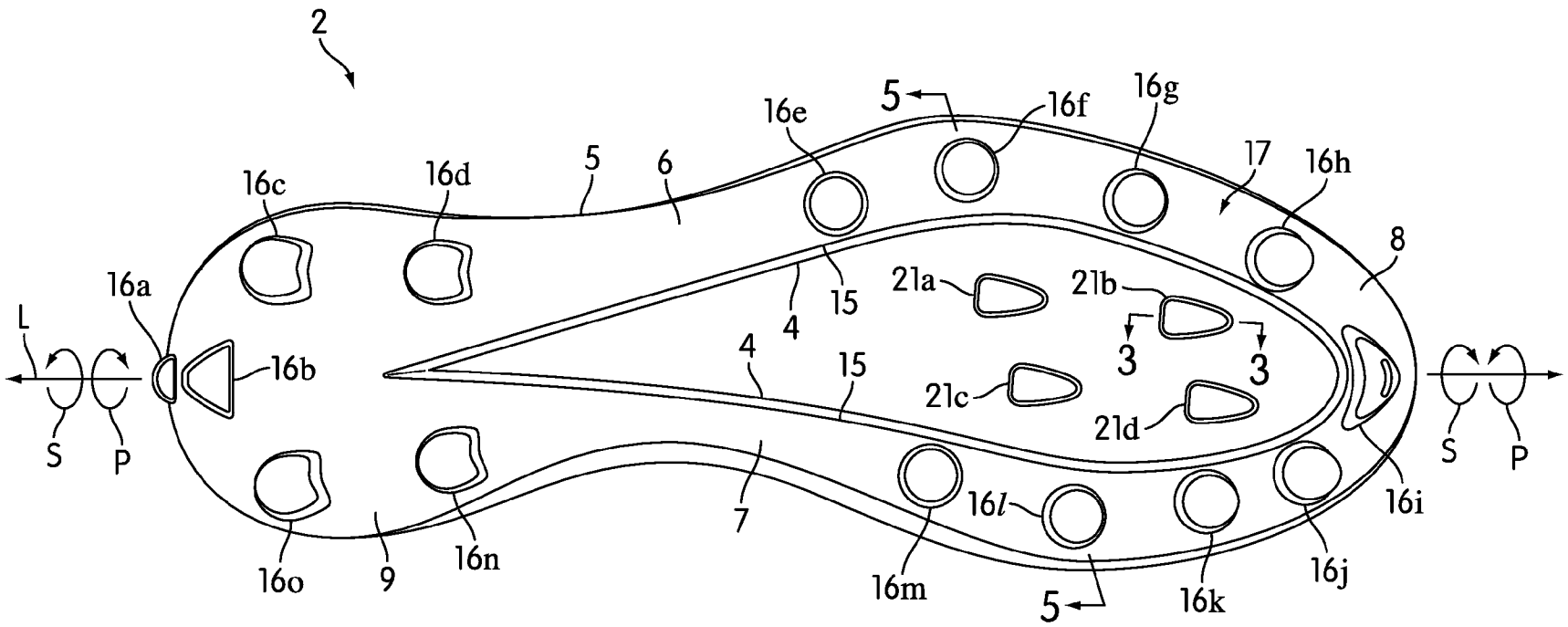
FIG. 2 a bottom view of a sole structure from the athletic shoe shown in FIG. 1.

FIG. 2 is a bottom view of sole structure 2 showing individual elements in more detail. The locations of certain regions in sole structure 2, in components of sole structure 2 and in sole structures (and sole structure components) according to other embodiments may be described with reference to human foot anatomy. Specifically, various regions may be described using foot bones of a person wearing a shoe that includes the sole structure of interest and that is properly sized for the wearing foot. For example, a "forefoot" region of a sole structure will generally lie under the metatarsal and phalangeal bones of a shoe wearer's foot and will extend beyond the wearer's toes to the frontmost portion of the sole structure. As partially seen in FIG. 1, the sole structure 2 embodiment also extend upwards over the sides of a wearer foot along the first metatarsal and first proximal phalange, along the fifth metatarsal and fifth proximal phalange, and in front of the toes. A "midfoot" region will generally lie under the cuboid, navicular, medial cuneiform, intermediate cuneiform and lateral cuneiform bones of the wearer's foot. The sole structure 2 embodiment also extends upward from a midfoot region to cover some corresponding side portions of the wearer foot. A "hindfoot" region extends from the midfoot region to (or past) the rearmost portion of the sole structure under the wearer calcaneus (heel bone). The sole structure 2 embodiment similarly extends upward from the hindfoot region over the lower sides of the wearer's heel. One or more of the above-described regions may overlap.

As used herein, a "forward" direction is a direction toward the frontmost portion of a sole structure. A "rearward" direction is a direction toward the rearmost portion of a sole structure. A "transverse" direction is a direction across a sole structure, and can be forward, rearward, medial, lateral, or some direction with both forward (or rearward) and medial (or lateral) components.

Turning to FIG. 2, and as indicated above, sole structure 2 includes a base member 5. Base member 5 includes a lateral peripheral branch 6, a medial peripheral branch 7, a toe element 8 and a heel plate 9. Peripheral branch 6 extends longitudinally along the lateral side of sole structure 2. Peripheral branch 7 extends longitudinally along the medial side of sole structure 2. Peripheral branches 6 and 7 are joined by toe element 8 in a forward portion of the forefoot region of sole structure 2. Branches 6 and 7 are also joined by heel plate 9 in a rearward portion of the heel region of sole structure 2.

Branches 6 and 7, toe element 8 and heel plate 9 form a frame element 17 having an opening 15 defined therein. In the embodiment of sole structure 2, opening 15 is completely open throughout its entire length. Stated differently, base member 5 includes no bridges or other extensions spanning opening 15 in the area between toe bridge 8 and heel plate 9. In some embodiments, and as shown for sole structure 2, opening 15 extends longitudinally from approximately the third middle phalange to approximately the center of the calcaneus and extends transversely, at its widest part, so as to generally lie under the second, third and fourth metatarsal phalangeal joints.

Base member 5 includes multiple primary traction elements 16*a* through 16*o* distributed across branches 6 and 7, toe element 8 and heel plate 9. For convenience, traction elements 16*a*-16*o* may be referred to collectively as "traction elements 16." Primary traction elements 16*e*-16*h* and 16*j*-16*m* are generally frusto-conical in shape and have circular cross sections. Element 16*i* has an arcuate cross section. Elements 16*c*, 16*d*, 16*n* and 16*o* have D-shaped cross-sections and elements 16*a* and 16*b* have triangular cross-sections. Other embodiments may have primary traction elements with other shapes and/or may have a different distribution of primary traction elements across a base member. Similarly, base members of other embodiments may have more or fewer primary traction elements.

The frame element 17 formed by branches 6 and 7, toe bridge 8 and heel plate 9 may be a single piece molded from thermoplastic polyurethane (TPU) or other wear-resistant polymer. Frame element 17 is generally incompressible under typical loads experienced during normal wear associated with athletic activities. As used herein, a material can be considered "compressible" if a volume reduction of that material can be detected (visually or tactilely) by a normal human without the aid of a measuring device. Conversely, a material can be considered incompressible if no volume reduction can be detected (visually or tactilely) by a normal human without the aid of a measuring device. A load is experienced during normal wear associated with an athletic activity if the load results from force of the wearer's own weight (e.g., while standing) and/or from the wearer moving from forces generated by his or her own muscular activity.

Frame element 17 provides structural reinforcement along the edges of sole structure 2. Branches 6 and 7 support a large portion of a wearer's weight and distribute the pressure from contact with the ground by elements 16*e*-16*h* and 16*j*-16*m*. The absence of base member material in opening 15 offers multiple advantages. For example, elimination of base member material in the region of opening 15 helps reduce overall shoe weight. Moreover, the presence of opening 15 helps facilitate torsional twisting of sole structure 2 about longitudinal axis L. During normal running, the foot will typically roll inward (or pronate) and then roll outward (or supinate). This corresponds to alternately twisting sole structure 2 about axis L in one direction during pronation (arrows P) and in the opposite direction during supination (arrows S). By permitting sole structure 2 to twist in this manner, there is less resistance to the natural rolling of a wearer foot during running. In turn, this may tend to help provide increased flexibility and thereby increase comfort for a wearer of shoe 1.

Any of traction elements 16 may be integrally formed portions of frame element 17. Any of traction elements 16 may alternatively include one or more components that are formed separately from frame element 17 and then attached to frame element 17 using threaded posts or other type of mechanical connections. Some or all of traction elements 16, whether integral or separate, can be rigid and/or incompressible. Some or all of elements 16 may alternatively be compressible or otherwise able to reduce length in response to different foot forces. As but one example, one or more of elements 16 could include a compressible body joined to frame element 17 and an attached durable end piece designed to contact the ground. Such elements are described in commonly-owned U.S. patent application Ser. No. 12/752,318, titled "Traction Elements" and filed Apr. 1, 2010, which application is incorporated by reference herein. Some embodiments may include combinations of rigid, compressible and other types of primary traction elements.

A large portion of a support plate 20 is directly exposed by opening 15. Support plate 20 may be formed from, e.g., composites of carbon and/or glass fibers bound in NYLON (i.e., one or more types of polyamide) or other polymer material(s). As to the directly exposed portion of plate 20, and with the possible exception of paint, decals or other coatings or applications providing no significant structural reinforcement, there are no additional members separating that exposed portion of plate 20 from contact with the ground or with other elements in the external environment. In other embodiments, some portions of the bottom surface of a support plate between edges of a base member opening may have a coating of TPU or other material that does provide some structural reinforcement. For example, in some embodiments only a portion of a support plate in a forefoot region of a base member opening is directly exposed. In still other embodiments, much of the bottom surface of a support plate between edges of a base member opening may have a coating of TPU or other material, but that coating may include score lines or sipes to reduce resistance to twisting of the sole structure about a longitudinal axis.

Support plate 20 generally extends over much of the length sole of structure 2. As can be seen in additional detail in FIG. 7 (discussed below), support plate 7 generally lies under the plantar (or bottom) of the forefoot, midfoot and hindfoot regions of a wearer's foot. Support plate 7, which can be contoured to roughly correspond to a normal plantar foot curvature, helps to maintain proper foot shape and support the wearer foot. Although support plate 7 may be formed from a material that is significantly stiffer than material used for base member 5 or midsole 4, support plate 7 is sufficiently long and sufficiently thin to permit the above-described twisting of sole structure 2 about axis L.

Figure 3:
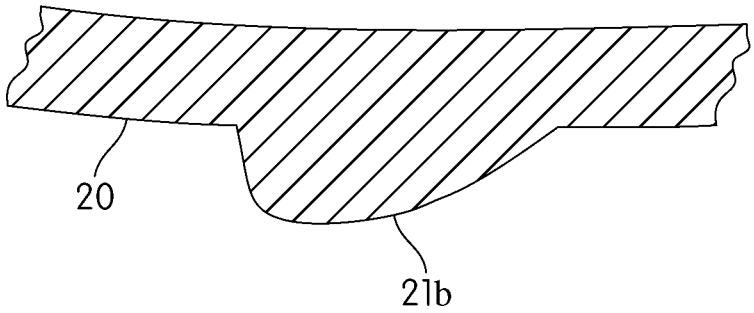
FIG. 3 is an enlarged cross-sectional view of a portion of a support plate taken from the location indicated in FIG. 2.

A plurality of secondary traction elements 21*a* through 21*d* are located in a forefoot region of support plate 20. Secondary elements 21, which are shorter than primary elements 16, are generally rigid and incompressible under normal loads. FIG. 3 is an enlarged cross-sectional view of a portion of plate 20 taken from the location shown in FIG. 2 and rotated 180° clockwise. Element 21*b* is an integrally-formed, outwardly-extending protrusion of support plate 20. Elements 21*a*, 21*c* and 21*d* are similar to element 21*b* and also integral to support plate 20. The number, size and/or location of secondary support elements may vary in other embodiments.

As partially shown in FIG. 2, and as explained in more detail below in connection with FIG. 5, support plate 20 is separated from base member 5 by midsole 4. Only a small portion of midsole 4 is visible in FIG. 2 along the edges of opening 15. In the embodiment of sole structure 2, for example, a small strip of midsole 4 material having a width of 1-3 millimeters (mm) follows the edges of opening 15. Accordingly, the directly exposed portion of support plate 20 is directly exposed in substantially all of opening 15.

Figure 4:
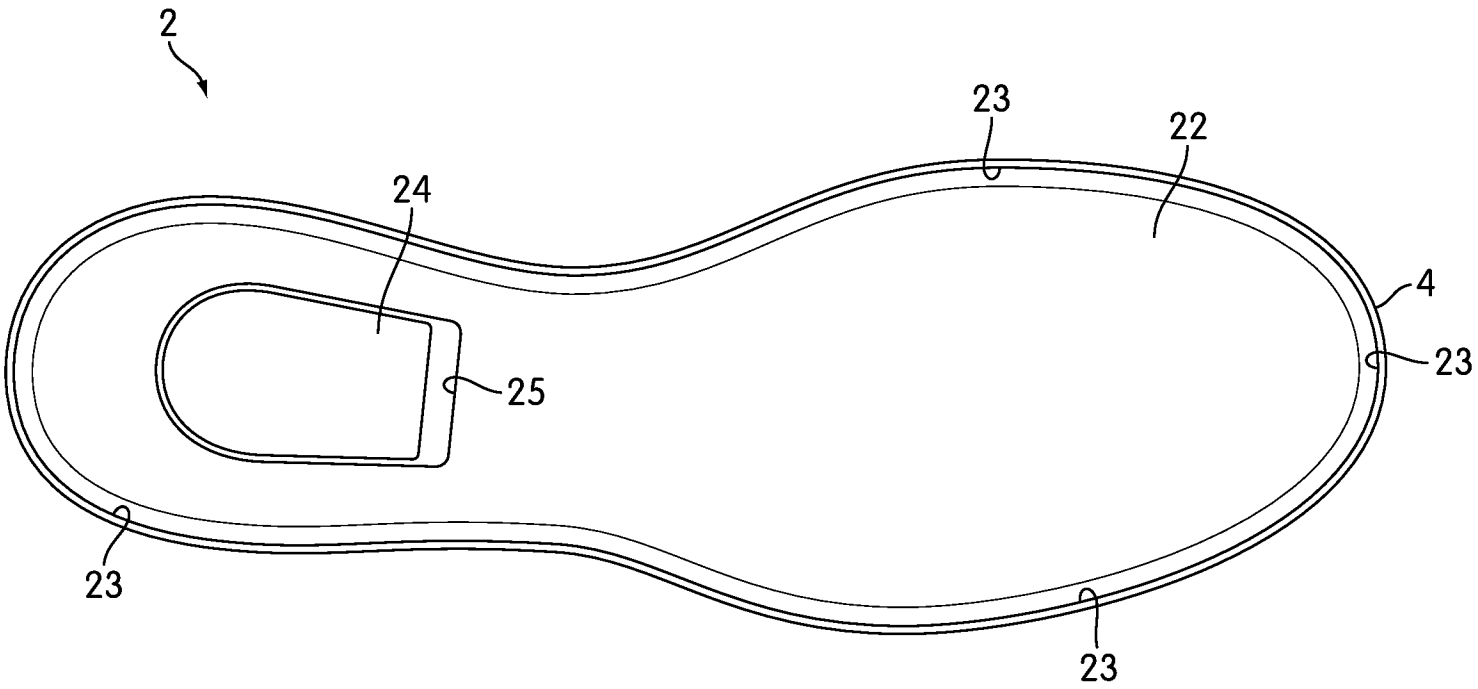
FIG. 4 is a top view of the sole structure from the athletic shoe shown in FIG. 1.

FIG. 4 is a top view of sole structure 2 and shows the top surface 22 and inner surfaces 23 of midsole 4. Midsole 4 may be formed from a foamed polymer such as a compressed ethylene vinyl acetate (EVA) foam (Phylon). Alternate materials for midsole 4 can include foamed polyurethanes, foamed TPU, or other compressible materials. Midsole 4 is compressible during normal wear and athletic activity so as to conform to and cushion a wearer's foot. A gas- or liquid-filled heel pad 24 can be included in a depression 25 in a heel region of midsole 4 to provide additional cushioning. In some embodiments, a gas- or liquid-filled forefoot pad (not shown) can also or alternatively be included. Top surface 22 of midsole 4 is contoured so as to generally conform to the plantar region of a wearer's foot. Surface 22 may be directly bonded to a lasting sock or other corresponding portion of upper 3 that contacts surface 22. Inner surfaces 23 of midsole 4 can similarly be bonded to side regions of upper 3.

Figure 5:
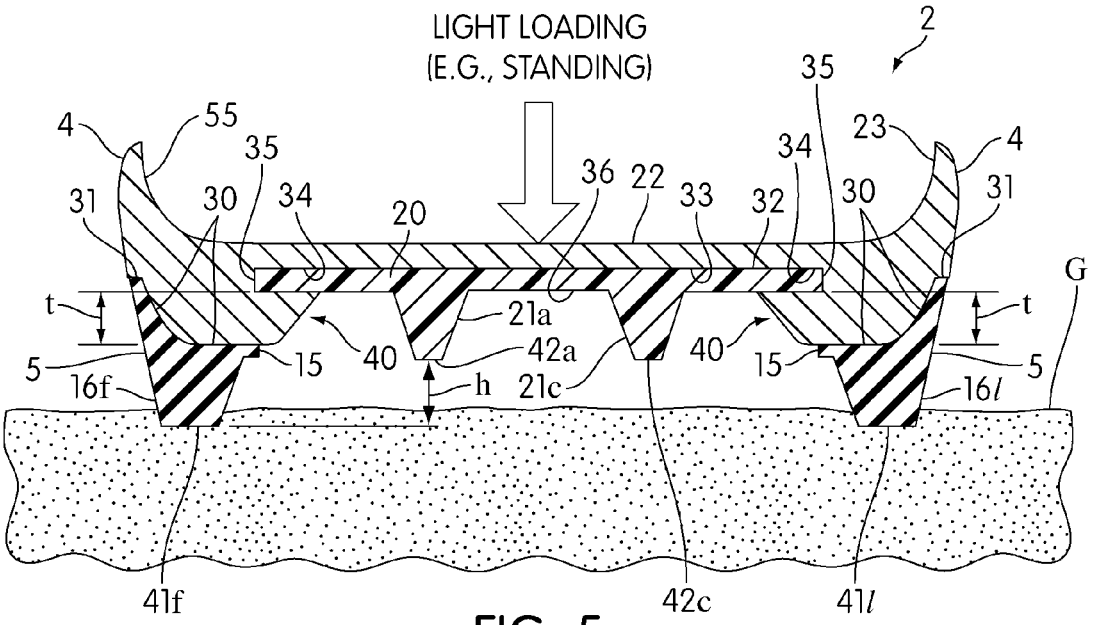
FIG. 5 is an enlarged cross-sectional view, taken from the location indicated in FIG. 2, of the sole structure of the athletic shoe shown in FIG. 1.

FIG. 5 is an enlarged cross-sectional view of sole structure 2 taken from the location indicated in FIG. 2 and rotated 90 degrees counterclockwise. As explained in more detail below, FIG. 5 further assumes sole structure 2 is resting on a moderately firm playing surface G. For convenience, and to avoid obscuring FIG. 5 with unnecessary details, elements of sole structure 2 rearward of the cross-sectional plane have been omitted. An internal shelf 30 is formed around the inner edge of base member 5. Shelf 30 extends from the edges of opening 15 to the top edges 31 of base member 5, and thus includes both horizontal and upwardly curving vertical faces. Although not shown in FIG. 5, shelf 30 completely surrounds opening 15, and has a substantially wider inner bottom surface in the heel region (see FIG. 7).

Portions of the outer bottom and outer side surfaces of midsole 4 correspond to and are bonded to shelf 30. A top surface 32 of support plate 20 is bonded to an outer bottom surface 33 of midsole 4. In at least some embodiments, a bond margin (i.e., a distance along an interface between two bonded components) of at least 8 mm is provided for bonds between midsole 4 and base member 5 and for bonds between midsole 5 and support plate 20. In the embodiment of sole structure 2, the portion of midsole 4 covering top surface 32 of support plate 20 is approximately 2 mm in thickness. In some embodiments, and as shown in FIG. 5, midsole 4 may further include a pocket 34 that surrounds and contains the outer edge 35 of plate 20 around the entire periphery of plate 20.

Midsole 4 includes an interface region 40 that separates support plate 20 from the bottom surface of shelf 30. This separation, which can be provided around the entire periphery of plate 20, isolates incompressible plate 20 from incompressible base member 4 with a layer of compressible material. Because support plate 20 is isolated from base member 4, primary fraction elements in the forefoot region of base member 4 (including elements 16*f* and 16*l*) are isolated from secondary traction elements (including elements 21*a* and 21*c*) in the forefoot region. Secondary traction elements attached to plate 20 are similarly isolated from primary traction elements in other regions of base member 4.

In the region of sole structure 2 corresponding to the cross-sectional plane of FIG. 5, interface region 40 separates the bottom surface of shelf 30 and the underside 36 of support plate 20 by a thickness t under light loading. Similarly, the distal end 41*f* of primary traction element 16*f* is vertically separated from the distal end 42*a* of secondary traction element 21*a* by a distance h. Although not marked in FIG. 5, the distal ends 42*c* and 41*l* of elements 21*c* and 16*l* are also separated by a distance h. Under increased load, and as explained in detail below, interface region 40 can be compressed to reduce thickness t and separation h. This thickness reduction allows relative movement between plate 20 and base member 5 in directions parallel to the directions in which primary traction elements 16*f* and 16*l* extend outward from the bottom of frame member 17 and in directions parallel to directions in which secondary fraction elements 21*a* and 21*c* extend outward from the bottom surface 36 of support plate 20.

The unloaded thickness of interface region 40 isolating plate 20 from base member 5 (i.e., the thickness of the interface region when shoe 1 is not worn or otherwise loaded) need not be the same throughout all of interface region 40. Stated differently, interface region 40 may be thicker in some parts of sole structure 2 and thinner in other parts of sole structure 2. For example, interface region 40 can be thicker in regions where it is desired to provide more cushioning and/or to permit a greater degree of relative movement between base member 5 and support plate 20.

FIG. 5 assumes that shoe 1 is being worn and that sole structure 2 is resting on a moderately firm playing surface G. FIG. 5 further assumes that sole structure 2 is lightly loaded (e.g., a wearer of shoe 1 may be standing still or walking) Because of the light load condition, various primary traction elements 16 only slightly penetrate surface G. Moreover, interface region 40 is only slightly compressed. Support plate 20 is elevated above surface G, and secondary traction elements 21 are not contacting surface G. Because elements 21 are not contacting the ground, no point pressures around elements 21 are created, and wearer comfort is thereby enhanced.

Figure 6:
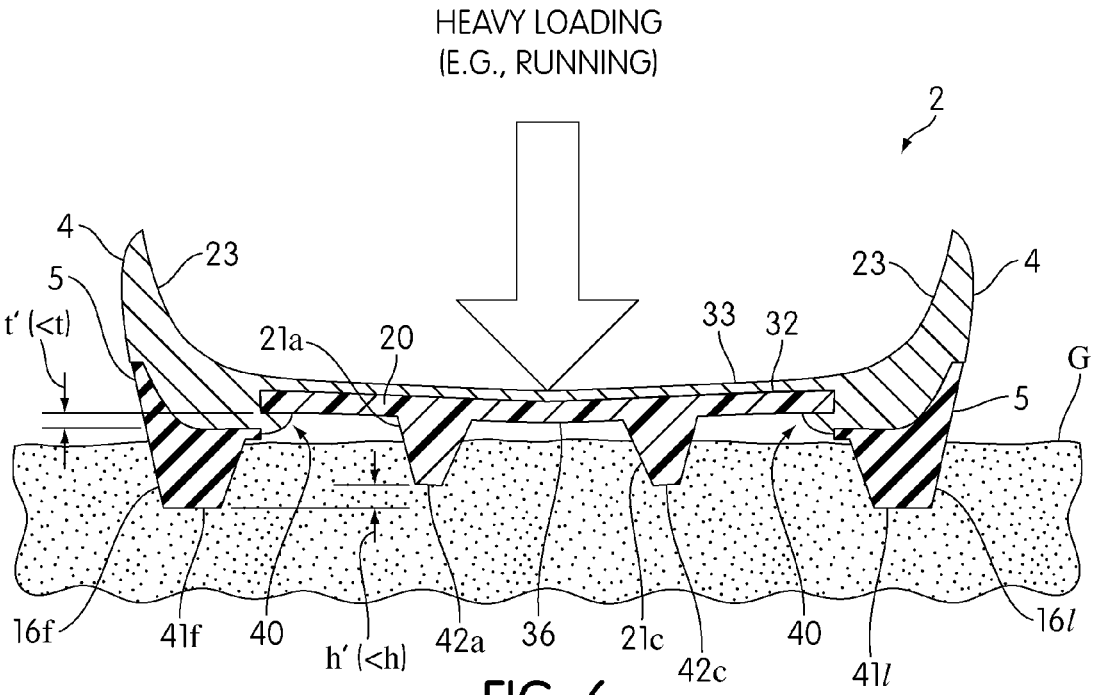
FIG. 6 is an enlarged cross-sectional view similar to FIG. 5, but showing the sole structure under load in a typical usage environment.

FIG. 6 is a cross-sectional view of sole structure 2 similar to FIG. 5, but showing sole structure 2 in a more heavily loaded condition. In particular, the wearer of shoe 1 is exerting significantly more downward force on shoe 1 relative to downward forces associated with standing still or walking. For example, the shoe 1 wearer may be running hard and pushing off using the forefoot region of sole structure 2, may be pushing against another player, etc. The downward force of the load is transferred through the central portion of midsole 4 into support plate 20. Support plate 20 transfers that force downward and compresses interface region 40, in the region of the cross-sectional plane, to have a thickness t' that is less than thickness t (shown in FIG. 5).

For convenience, reduction of t is only indicated on the left side of FIG. 6, which corresponds to the lateral side of sole structure 2. The thickness t may also be reduced on the medial side of sole structure 2 (and on the right side of FIG. 6). Depending on the type of activity in which the wearer of shoe 1 is engaging, however, that thickness reduction on the medial side may be greater or less than the thickness reduction on the lateral side. For example, the wearer could be applying more force to the lateral side of his or her foot than is being applied to the medial side. The thickness of interface region 40 would similarly be reduced in areas forward and rearward of the FIG. 6 cross-sectional plane. The degree of thickness reduction in any particular part of interface region 40 will depend on the specific activity of the wearer.

The thickness reduction of interface region 40 moves the underside 36 of plate 20 downward relative to base member 5. This downward motion of plate 20 relative to base member 5 reduces the vertical separation between distal ends 41*f* and 42*a* from h to h'. The vertical separation between distal ends 41*l* and 42*c* could also be reduced, depending on the specific wearer activity, by the same amount or by a different amount. At least in part because of the reduction in distal end separation, distal ends 42*a* and 42*c* of secondary traction elements 21*a* and 21*c* (as well as distal ends of traction elements 21*b* and 21*d*) contact playing surface G. As a result, secondary traction elements 21 provide stabilization of sole structure 2, relative to surface G, in addition to the stabilization provided by one or more of primary traction elements 16.

As can be appreciated, additional stabilization of sole structure 2 relative to the ground will often be needed during the same activities that impart heavier loading on sole structure 2. Conversely, that additional stabilization will be less needed during activities that impart lighter loading. By reducing the contact between secondary elements 21 and the ground under lighter loading conditions, the adverse effects of secondary elements 21 on wearer comfort can be reduced. This results in an adaptive fraction that can be achieved using a relatively simple structural configuration. This simple configuration can have a small number of components and can facilitate relatively simple assembly during a manufacturing process.

Other factors may also contribute to moving one or more of secondary traction elements 21 into contact with surface G. Although exaggerated in FIG. 6 for purposes of illustration, support plate 20 may also deform slightly by bowing outward. This can result in additional relative movement of traction elements 21 relative to base member 5, and may thus further move elements 21 toward the ground. As also shown in FIG. 6, primary traction elements 16*f* and 16*l* penetrate surface G to a greater degree under heavier loading. Others of primary traction elements 16 could similarly penetrate surface G more deeply under heavier loading. Deeper penetration by primary traction elements will, apart from relative movement between support plate 20 and base member 4, help move secondary fraction elements 21 closer to the ground. One or more of primary traction elements 16 may also penetrate deeper into surface G when surface G is softer. However, deeper primary traction element penetration and/or support plate deformation will also occur under conditions in which additional traction is desired. Notably, softer ground is often associated with mud or other conditions that are also more slippery, and in which the additional traction from elements 21 would be desired.

In some embodiments, there may be little or no transverse overlap between plate 20 and base member 5 in some portions of sole structure 2. This is shown in FIG. 5, where the edges 35 of plate 20 generally correspond to the edge of opening 15 in the regions associated with the FIG. 5 cross-sectional plane. In other regions (e.g., in the heel regions), plate 20 and base member 5 may have transverse overlap. In some embodiments, a support plate and a base member may overlap around the entire periphery of the support plate.

Figure 7:
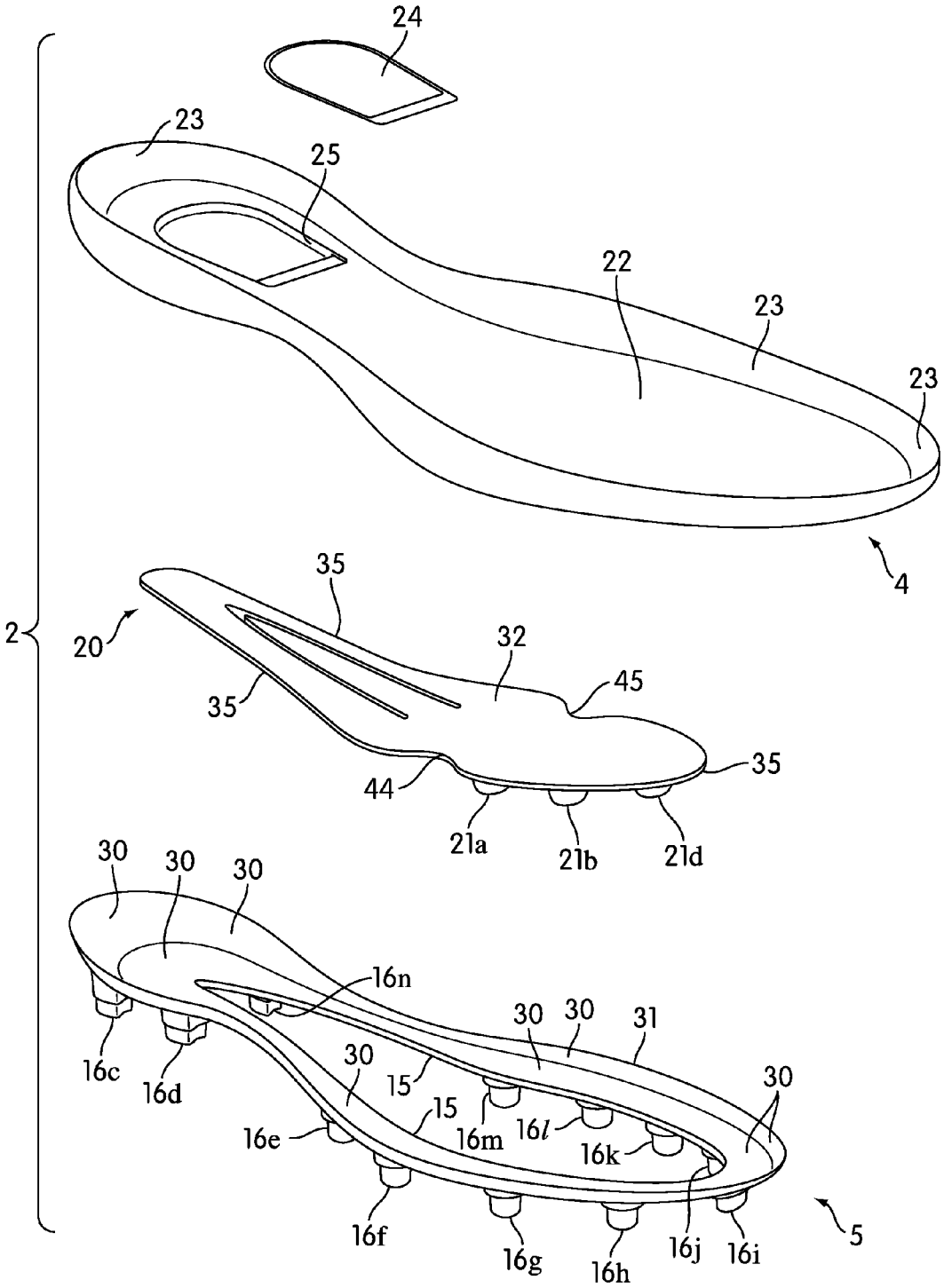
FIG. 7 is an exploded perspective view of the sole structure from the athletic shoe shown in FIG. 1.

FIG. 7 is an exploded, lateral perspective view of sole structure 2. FIG. 7 shows additional details of support plate 20. Although support plate 20 is generally incompressible, it is flexible along various axes. For example, support plate 20 can include cutouts 44 and 45 in the forefoot region to allow easier flexion of the foot during walking and running Although not visible in the drawings, the open spaces of cutouts 44 and 45 can be filled by compressible material of midsole 4 when edges 35 of plate 20 rest within pocket 34 of midsole 4. As discussed above in connection with FIG. 2, the length and thickness of plate 20 accommodates torsional twisting of sole structure 2 about longitudinal axis L. Notwithstanding its flexibility, plate 20 has substantial resilience and spring-like characteristics. This resilience helps to keep plate 20 (and thus other components of sole structure 2) conformed to a wearer's foot during athletic activities.

Figure 8:
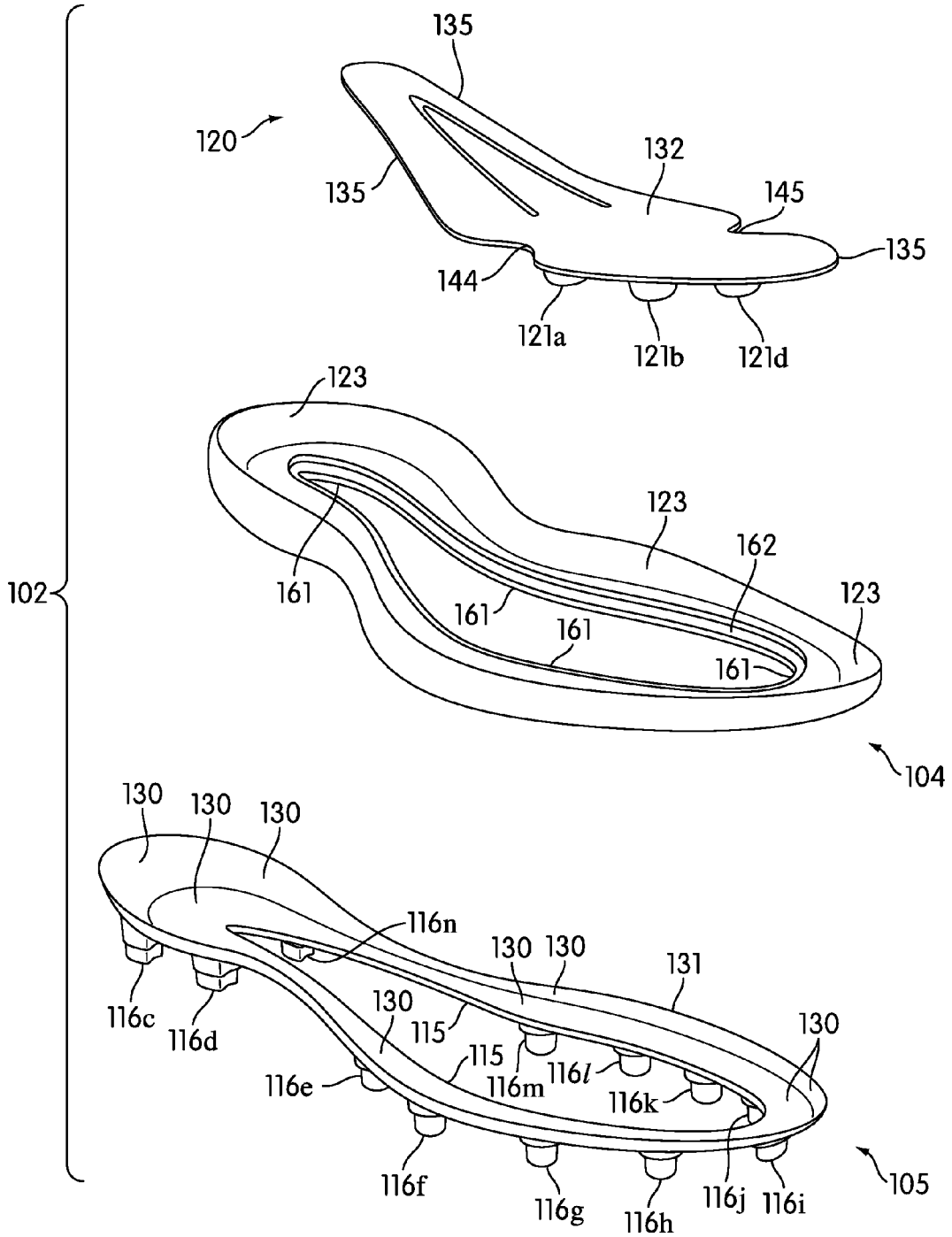
FIG. 8 is an exploded perspective view of a sole structure from an athletic shoe according to another embodiment.

FIG. 8 is an exploded, cross-sectional view of a sole structure 102 according to another embodiment. Except as discussed below, sole structure 102 is similar to sole structure 2. In particular, and except as described below, features in the embodiment of sole structure 102 are structurally similar to features in FIGS. 1-7 having similar reference numbers offset by 100. For example, and without limitation, base element 105, opening 115, primary traction elements 116, support plate 120 and secondary traction elements 121 of FIGS. 8-10 are respectively similar to base element 5, opening 15, primary traction elements 16, support plate 20 and secondary traction elements 21 of FIGS. 1-7.

Midsole 104 rests within and is bonded to base element 105 in a manner similar to that of midsole 4 and base element 5. However, and unlike midsole 4, midsole 104 has an opening 161 formed in its interior regions. The shape of opening 161 generally corresponds to the shape of support plate 120.

Figure 9:
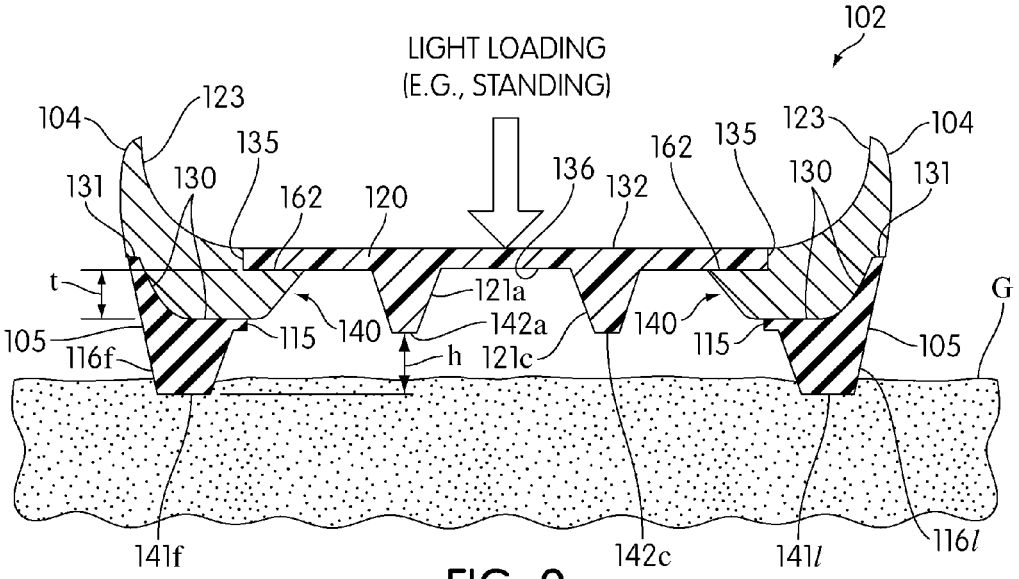
FIGS. 9 and 10 are enlarged cross-sectional views of the sole structure from FIG. 8.

FIG. 9 is an enlarged cross-sectional view of sole structure 102 taken from a location in sole structure 102 similar to the location of sole structure 2 from which the cross-sectional view of FIG. 5 was taken. As with FIG. 5, elements of sole structure 102 rearward of the cross-sectional plane have been omitted. FIG. 9, similar to FIG. 5, also assumes that sole structure 102 is resting on a relatively firm but penetrable playing surface G and that sole structure 102 is lightly loaded. As seen in FIG. 9, the top surface 132 of plate 120 is not covered by midsole 104. Similar to sole structure 2, however, incompressible plate 120 is isolated from incompressible base element 105 by an isolating region 140 of compressible midsole 104. As seen in FIG. 9 and in FIG. 8, a ledge 162 is formed about the edge of opening 161 to receive support plate 120. Although not shown in FIG. 8, portions of ledge 162 corresponding to cutouts 144 and 145 could be raised so as to fill the open spaces of cutouts 144 and 145 with compressible material of midsole 104

Figure 10:
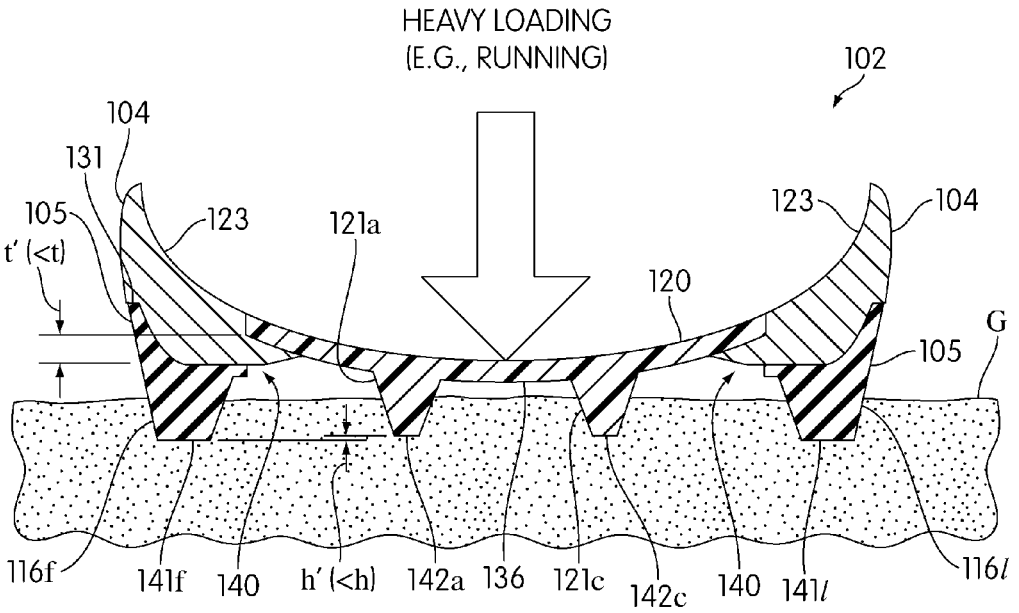

FIG. 10 is a cross-sectional view of sole structure 102 similar to FIG. 9, but showing sole structure 102 in a more heavily loaded condition (as in FIG. 6). The downward force of the load is transferred into support plate 120. Similar to the operation of sole structure 2, support plate 120 transfers that force downward and compresses interface region 140, thereby moving underside 136 of plate 120 downward relative to base member 105. This allows one or more of secondary traction elements 121 to contact playing surface G and provide additional stabilization of sole structure 102 relative to surface G. One or more of secondary elements 121 may also move toward and contact surface G because of deeper penetration into surface G by primary elements 116 and/or because of outward bowing of plate 120 (which bowing is exaggerated to a greater degree in FIG. 10 than in FIG. 6).

Sole structure 102 offers many of the same advantages as sole structure 2, but may allow greater twisting about the shoe longitudinal axis to accommodate pronation and supination. Although the absence of a compressible midsole layer between surface 132 and an upper (not shown) may decrease wearer comfort in some respects, at least some of that reduction may be offset by additional comfort resulting from greater longitudinal twisting.

Various techniques can be used to fabricate sole structures such as are described herein. As to sole structure 2, for example, midsole 4 can be separately fabricated using conventional molding techniques. A TPU frame element of base element 5 can similarly be molded using conventional techniques. Support plate 20 can be created using conventional techniques for fabricating polymer composite structural elements (e.g., layup and vacuum molding). Plate 20 can then be bonded to midsole 4 by inserting edge 35 into pocket 34 using an appropriate glue or other bonding agent. Midsole 4 can then be bonded to the frame element of base assembly 5. Primary traction elements, if not integral to the TPU frame element, can be attached before or after bonding midsole 4 to the frame assembly. After assembly (including placement of heel pad 24), a completed sole structure can be bonded to an upper that has been secured to a last.

Other fabrication techniques could also be used. For example, base element 5 and support plate 20 could be placed into a mold. Midsole 4 could then be molded in place around plate 20 and base element 5.

Sole structures having one or more of the features described herein offer various other potential advantages. In addition to the on-demand additional traction described above, for example, a compressible foam midsole helps to moderate the pressure from primary traction elements that are transferred to a wearer's foot. The flexibility and spring-like nature of the support plate also helps to attenuate ground impact forces by slowing the downward movement of the foot.

The foregoing description of embodiments has been presented for purposes of illustration and description. The foregoing description is not intended to be exhaustive or to limit embodiments to the precise form explicitly described or mentioned herein. Modifications and variations are possible in light of the above teachings or may be acquired from practice of various embodiments. The embodiments discussed herein were chosen and described in order to explain the principles and the nature of various embodiments and their practical application to enable one skilled in the art to make and use these and other embodiments with various modifications as are suited to the particular use contemplated. Any and all permutations of features from above-described embodiments are the within the scope of the invention. References in the claims to characteristics of a physical element relative to a wearer of claimed article, or relative to an activity performable while the claimed article is worn, do not require actual wearing of the article or performance of the referenced activity in order to satisfy the claim.

The invention claimed is:

1. An article of footwear comprising a sole structure, the sole structure further comprising:

a base member having longitudinally extending peripheral branches on medial and lateral sides of the sole structure, a plurality of primary traction elements extending outward from the peripheral branches in a forefoot region of the sole structure, and a base member opening located between the peripheral branches in at least the forefoot region of the sole structure, and wherein the base member includes a frame member, the frame member being incompressible under loads experienced during normal wear associated with athletic activities;

a flexible support plate spanning at least a portion of the base member opening and having an exposed surface located between the longitudinally extending peripheral branches in the forefoot region, the support plate including at least one exposed secondary traction element integral to and extending outward from the exposed surface, the at least one secondary traction element having a length shorter than a length of at least one of the primary traction elements, and wherein the support plate is incompressible under loads experienced during normal wear associated with athletic activities; and a compressible midsole isolating the support plate from the base member in directions in which the primary traction elements extend outward.

2. The article of footwear of claim 1, wherein the base member opening extends longitudinally from a third middle phalange region of the sole structure to a center calcaneus region of the sole structure.

3. The article of footwear of claim 2, wherein the support plate is exposed in substantially all of the base member opening.

4. The article of footwear of claim 1, wherein the midsole covers a top of the support plate.

5. The article of footwear of claim 1, wherein the midsole is configured to reduce, in response to loads experienced during normal wear associated with athletic activities, a vertical separation between a distal end of the at least one secondary traction element and a distal end of one of the primary traction elements.

6. The article of footwear of claim 1 wherein the midsole is configured to separate a distal end of the at least one secondary traction element from a substantially flat ground surface when distal ends of the primary traction elements contact the ground surface and the article is subject to a first load, and the midsole is configured to place the distal end of the at least one secondary traction element into contact with the ground surface when the distal ends of the primary traction elements contact the ground surface and the article is subjected to a second load, the second load being in excess of the first load, both the first and second loads being loads experienced during normal wear of the article during an athletic activity.

7. The article of footwear of claim 1, wherein the midsole is formed from a compressed polymer foam, the longitudinally extending peripheral branches of the base member are formed from thermoplastic polyurethane, and the support plate is formed from a composite of a polymer and at least one of glass fibers and carbon fibers.

8. An article of footwear comprising a sole structure, the sole structure further comprising:

a plurality of primary traction elements having distal ends positioned to contact a ground surface when the article is worn by a human wearer standing on the ground surface;

a support plate having a continuous exposed portion located in forefoot, midfoot and hindfoot regions of the sole structure;

a plurality of secondary traction elements integral to and extending outward from the support plate, each of the secondary traction elements having an exposed distal end;

a compressible midsole having an interface region isolating the support plate from the primary traction elements, wherein the midsole is bonded to the support plate, and wherein the midsole is configured to permit, in response to loads experienced during normal wear associated with athletic activities, a reduction of a vertical separation between at least one of the secondary traction element distal ends and at least one of the primary traction element distal ends; and a frame member bonded to the midsole and having lateral and medial peripheral branches, a toe bridge connecting the lateral and medial peripheral branches, and a heel plate connecting the lateral and medial peripheral branches, wherein the primary traction elements are attached to and extend from the frame member, and wherein the frame member and the support plate are incompressible under loads experienced during normal wear associated with athletic activities.

9. The article of footwear of claim 8, wherein the frame member is formed from thermoplastic polyurethane, the support plate is formed from a composite of a polymer and at least one of glass fibers and carbon fibers, and the midsole is formed from compressed ethylene vinyl acetate foam.

10. The article of footwear of claim 8, wherein the midsole covers a top of the support plate.

11. The article of footwear of claim 8, wherein the continuous exposed portion of the support plate is bounded by the frame member.

12. The article of footwear of claim 11, wherein the midsole is configured to separate the distal ends of the secondary traction elements from a substantially flat ground surface when the distal ends of the primary traction elements contact the ground surface and the article is subject to a first load, and the midsole is configured to place the distal ends of the secondary traction elements into contact with the ground surface when the distal ends of the primary traction elements contact the ground surface and the article is subjected to a second load, the second load being in excess of the first load, both the first and second loads being loads experienced during normal wear of the article during an athletic activity.

13. The article of footwear of claim 12, wherein a first portion of the midsole isolating the support plate from the frame member in a first region has a first thickness and a second portion of the midsole isolating the support plate from the frame member in a second region has a second thickness that is less than the first thickness, and wherein an opening bounded by the frame member and exposing the support plate extends transversely, at its widest part, so as to generally lie under second, third and fourth metatarsal joint regions of the sole structure.

14. An article of footwear comprising a sole structure, the sole structure further comprising:

a frame member having lateral and medial peripheral branches, a toe bridge connecting the lateral and medial peripheral branches, and a heel plate connecting the lateral and medial peripheral branches, the frame member defining a continuous frame member opening having portions located in forefoot, midfoot and hindfoot regions of the article;

a plurality of primary traction elements extending outward from the frame member;

a compressible midsole bonded to upper surfaces of the frame member;

a flexible support plate spanning substantially all of the frame member opening and having a lower surface exposed in at least a forefoot region of the frame member opening, the support plate being isolated from the frame member by the midsole; and a plurality of secondary traction elements integral to and extending from the support plate exposed lower surface, wherein the support plate is bonded to the midsole, wherein the frame member and the support plate are incompressible under loads experienced during normal wear associated with athletic activities, wherein the midsole is configured to separate distal ends of the secondary traction elements from a substantially flat ground surface when distal ends of the primary traction elements contact the ground surface and the article is subject to a first load, and wherein the midsole is configured to place the distal ends of the secondary traction elements into contact with the ground surface when the distal ends of the primary traction elements contact the ground surface and the article is subjected to a second load, the second load being in excess of the first load, both the first and second loads being loads experienced during normal wear of the article during an athletic activity.

15. The article of footwear of claim 14, wherein the midsole covers a top of the support plate.

16. The article of footwear of claim 14, wherein the support plate lower surface is exposed throughout substantially all of the frame member opening.

17. The article of footwear of claim 14, wherein the secondary traction elements have lengths that are less than lengths of at least some of the primary traction elements.

18. The article of footwear of claim 14, wherein the frame member is formed from thermoplastic polyurethane, the support plate is formed from a composite of a polymer and at least one of glass fibers and carbon fibers, and the midsole is formed from compressed ethylene vinyl acetate foam.

19. The article of footwear of claim 14, wherein a first portion of the midsole isolating the support plate from the frame member in a first region has a first thickness and a second portion of the midsole isolating the support plate from the frame member in a second region has a second thickness that is less than the first thickness, and wherein the frame member opening extends transversely, at its widest part, so as to generally lie under second, third and fourth metatarsal joint regions of the sole structure.

20. An article of footwear comprising a sole structure, the sole structure further comprising:

a base member having longitudinally extending peripheral branches on medial and lateral sides of the sole structure, a plurality of primary traction elements extending outward from lower sides of the peripheral branches in a forefoot region of the sole structure, and a base member opening located between the peripheral branches in at least the forefoot region of the sole structure, wherein the base member opening extends longitudinally from a third middle phalange region of the sole structure to a center calcaneus region of the sole structure;

a flexible support plate spanning at least a portion of the base member opening, the support plate comprising an upper surface, a lower surface, and an outer edge separating the upper surface from the lower surface, a peripheral portion of the lower surface surrounding an exposed portion of the lower surface and separating the exposed portion of the lower surface from the outer edge, the exposed portion of the lower surface located between the longitudinally extending peripheral branches in the forefoot region, the support plate including at least one exposed secondary traction element integral to and extending outward from the exposed portion of the lower surface, the at least one secondary traction element having a length shorter than a length of at least one of the primary traction elements, wherein the exposed portion of the lower surface extends throughout substantially all of the base member opening; and a compressible midsole isolating the support plate from the base member, wherein the peripheral portion of the lower surface is covered by an interface region of the midsole, the peripheral portion of the lower surface is above, and separated by the interface region from, an upper surface of the base member adjacent edges of the base member opening, and the support plate is bonded to the midsole.

21. The article of footwear of claim 20, wherein the midsole covers the outer edge and the upper surface of the support plate.

22. The article of footwear of claim 20, wherein the base member opening extends transversely, at its widest part, so as to generally lie under second, third and fourth metatarsal joint regions of the sole structure.

* * * * *